US011085745B1

(12) United States Patent
Pierce, Sr.

(10) Patent No.: US 11,085,745 B1
(45) Date of Patent: Aug. 10, 2021

(54) TWO STAGE PROJECTILE FOR ARMOR PIERCING

(71) Applicant: James Sherwood Pierce, Sr., Grand Rapids, MI (US)

(72) Inventor: James Sherwood Pierce, Sr., Grand Rapids, MI (US)

( * ) Notice: Subject to any disclaimer, the term of this patent is extended or adjusted under 35 U.S.C. 154(b) by 0 days.

(21) Appl. No.: 16/786,007

(22) Filed: Feb. 10, 2020

(51) Int. Cl.
*F42B 12/08* (2006.01)
*F42C 1/02* (2006.01)

(52) U.S. Cl.
CPC ..... *F42B 12/08* (2013.01); *F42C 1/02* (2013.01)

(58) Field of Classification Search
CPC ..... F42B 12/08; F42B 14/061; F42B 14/062; F42B 14/064; F42B 14/065; F42B 14/08; F42C 1/02; F42C 1/00; F42C 1/04; F42C 1/06; F42C 1/10; F42C 7/02; F42C 7/04
USPC ..... 102/520, 521, 522, 523, 216
See application file for complete search history.

(56) References Cited

U.S. PATENT DOCUMENTS 3,086,468 A * 4/1963 Mountjoy ..... F42C 19/06 102/216
3,158,705 A * 11/1964 Bliss ..... H01H 35/14 200/61.08
4,823,699 A * 4/1989 Farinacci ..... F42B 14/061 102/439
5,009,166 A 4/1991 Bilsbury et al.
5,214,238 A * 5/1993 Young ..... F42B 14/064 102/439
5,221,809 A * 6/1993 Cuadros ..... F42B 12/34 102/439
5,361,701 A * 11/1994 Stevens ..... C06B 33/00 102/450
6,105,506 A 8/2000 Gangale
7,197,984 B2 * 4/2007 Eches ..... F42B 14/061 102/521
7,377,204 B2 * 5/2008 Simmons ..... F41A 1/02 102/522
7,520,224 B2 4/2009 Taylor
8,161,886 B2 4/2012 Meyer
8,222,583 B2 * 7/2012 Fu ..... F42B 10/06 244/3.25
8,430,029 B2 * 4/2013 Bohnet ..... F42C 1/12 102/216
8,584,585 B2 * 11/2013 Bohnet ..... F42C 1/12 102/216
2004/0107826 A1 * 6/2004 Simmons ..... F41A 1/02 89/8
2005/0011397 A1 * 1/2005 Eches ..... F42B 14/061 102/523
2008/0011179 A1 * 1/2008 Michel ..... F42C 1/04 102/275
2009/0193995 A1 * 8/2009 Bohnet ..... F42C 1/10 102/501
2010/0237186 A1 * 9/2010 Fu ..... F42B 15/22 244/3.25
2013/0213252 A1 * 8/2013 Bohnet ..... F42C 1/00 102/216

* cited by examiner

*Primary Examiner* — Samir Abdosh
(74) *Attorney, Agent, or Firm* — Harpman & Harpman

(57) ABSTRACT

A multiple stage armor piercing projectile cartridge with a hardened steel projectile having a pyrotechnic end target contact cap. A secondary propellant cartridge with a steel conveyance housing providing additional kinetic impact penetrating force to the target.

10 Claims, 5 Drawing Sheets

TWO STAGE PROJECTILE FOR ARMOR PIERCING

BACKGROUND OF THE INVENTION

1. Technical Field

This invention relates to ammunition, specifically ammunition used in small arms having armor piercing capabilities having a secondary charge.

2. Description of Prior Art

Prior art armor piercing projectiles have been developed for use on a variety of weapons specifically by the military in a number of user specific requirements. Such military projectiles use a depleted uranium core due to its dense properties. Examples of projectile ammunition can also be seen in U.S. Pat. Nos. 5,009,166, 6,105,506, 7,520,224, and 8,161,886.

In U.S. Pat. No. 5,009,166 is directed to a low-cost penetrator projectile having a hard metal core with a hollow conical shape formed from low carbon steel in a series of progressive dies to achieve a Rockwell hardness of C50 and C55.

U.S. Pat. No. 6,105,506 claims a bullet body and a nonrotable sabot slug for shotguns with a jacketed bullet with a forward end hollow point and a metal sabot that comes in contact with the rifling in the gun barrel.

U.S. Pat. No. 7,520,224 discloses an advanced armor piercing projectile having a precision machine outer and inner component. The inner component is of a higher density than the outer and higher than that of armor plate such as tungsten.

U.S. Pat. No. 8,161,886 is directed to a short magnum shot shell cartridge and firing assembly wherein a sabot retaining shot shell cartridge chamber has a sub-caliber projectile.

Examples of armor piercing projectiles having a second projectile charge can be seen in U.S. Pat. Nos. 4,102,271, 4,497,253, 4,574,702, 4,597,333 and 5,728,968.

In U.S. Pat. No. 4,102,271, an armor piercing tandem shell or projectile can be seen having a rear shaped charge, hollow charge and a forward armor piercing device with a second hollow explosive charge to define a passageway in the target.

U.S. Pat. No. 4,497,253 claims an armor piercing projectile with a hard case and hollow charge with proximity fuse for activation before impact.

An armor piercing high explosive projectile with cartridge is disclosed in U.S. Pat. No. 4,574,702 wherein a contact igniter point discharges and drives splinters into a secondary explosive during the projectile rotation after leaving the gun barrel.

A compartment armor piercing projectile is illustrated in U.S. Pat. No. 4,593,333 that uses a central positional explosive charge to separate front and rear parts by a proximity fuse.

Finally, in U.S. Pat. No. 5,728,968 an armor penetrating projectile is disclosed with a rod penetration core for contact with a target for self-ignition of a thermite charge projecting a molten jet of material through the bore melting the armor plate at the point of impact.

SUMMARY OF THE INVENTION

A dual stage armor piercing projectile cartridge having an enhanced penetration core of high impact solid carbide hardened steel with a pyrotechnic cap extends from a conveyance steel housing form socket. A secondary propellant cartridge with primer within the conveyance housing fires on contact with the target providing enhanced armor piercing projecting capabilities. A stabilization sabot of synthetic resin material surrounds the steel housing defining a twelve-gauge projectile all within a conventional twelve-gauge cartridge hull with a propellant and primer.

DETAILED DESCRIPTION OF THE INVENTION

Figure 1:
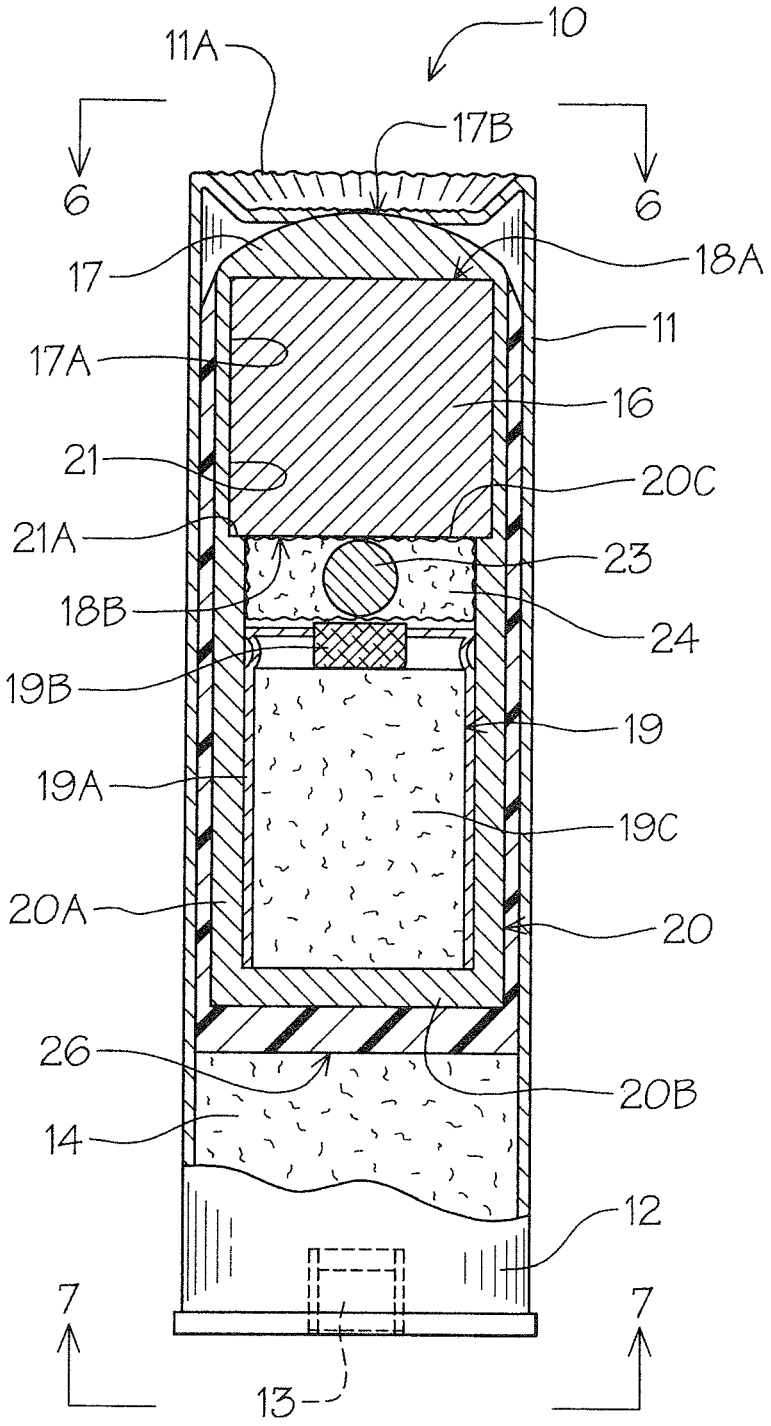
FIG. 1 is a partial sectional view of the two-stage component armor piercing projectile cartridge of the invention.
Figure 2:
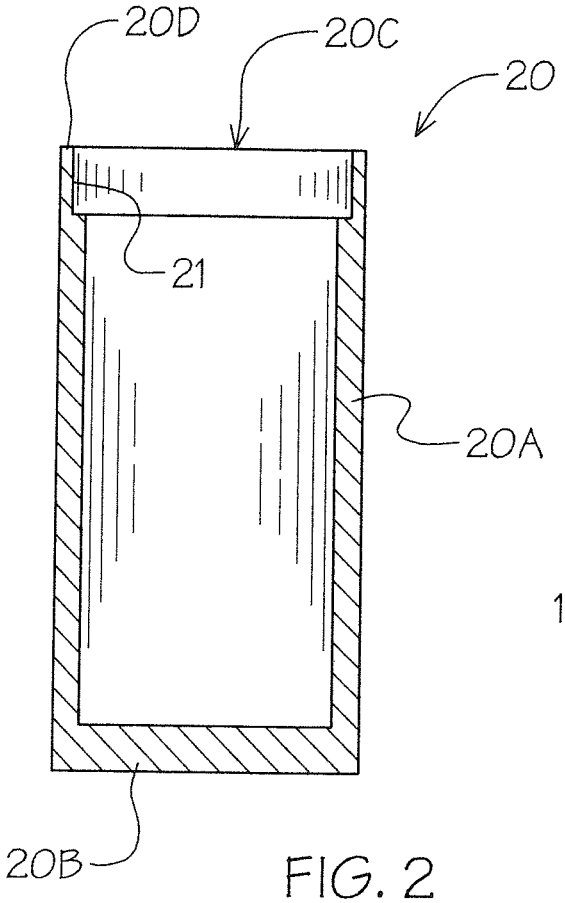
FIG. 2 is a cross-sectional view of a steel housing of the defined projectile socket.

Referring now to FIG. 1 of the drawings, a composite two-stage armor piercing projectile cartridge 10 of the invention can be seen which is adapted to be fired in an appropriate gauge firearm, not shown. The composite two-stage armor piercing projectile cartridge 10 comprises a cylindrical hollow cartridge hull 11 with a brass head 12 and a center primer 13 with a propellant charge 14 as will be well understood by those skilled in the art. The cylindrical hull 11 has an open-end front portion which is crimped inwardly at 11A around its free edge to retain the second stage projectile assembly as will be discussed hereinafter and a base portion closed by the brass head 12. The cartridge hull 11 is typically made of synthetic resin plastic or treated cardboard as is commonly used within the art.

Figure 9:
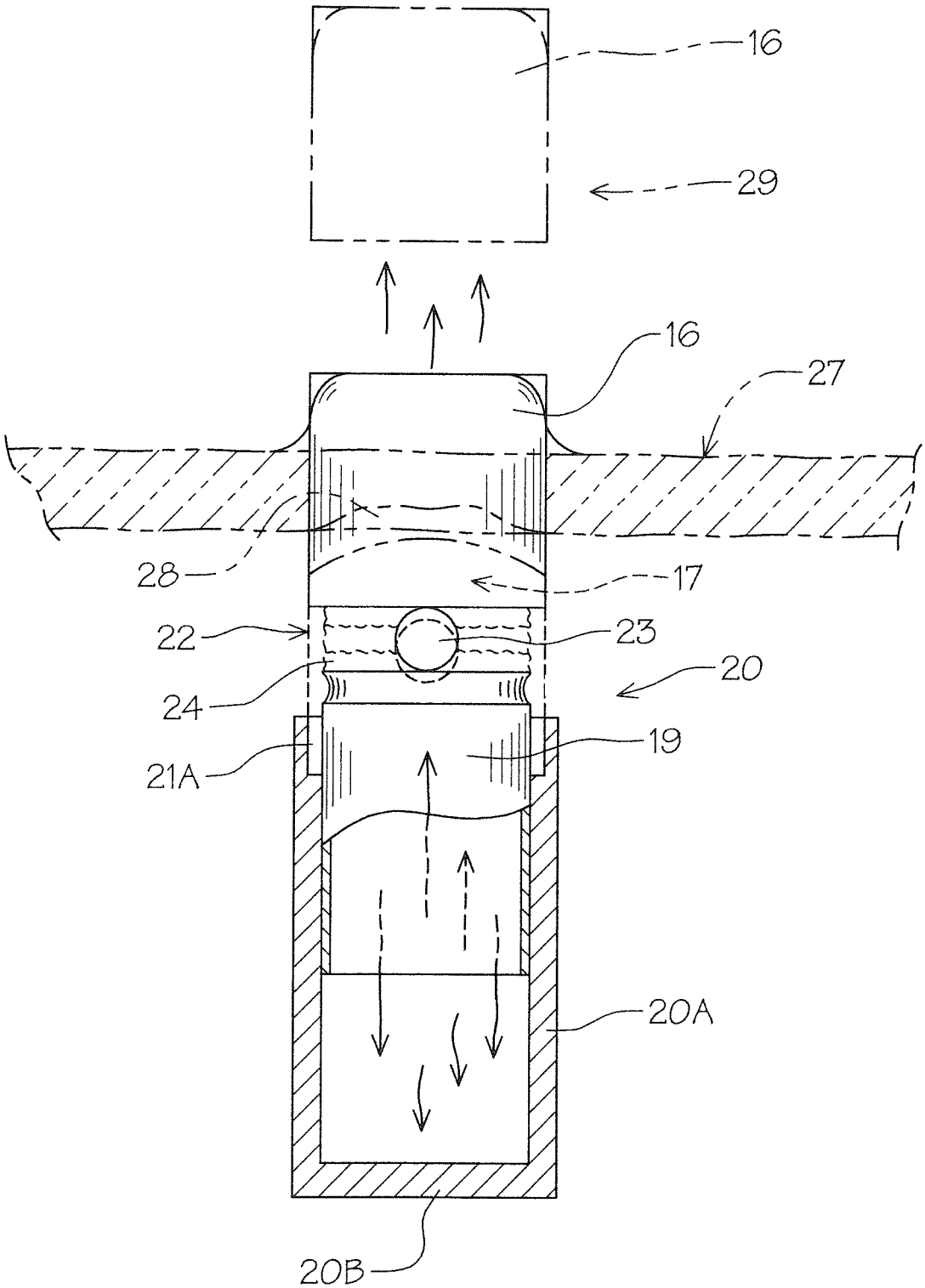
FIG. 9 is an exploded partial cross-sectional view of the component armor piercing projectile upon target impact and penetration in broken and solid lines respectively.

The composite two-stage projectile cartridge 10 of the invention is capable of penetrating AR500 grade designated armor plate AP graphically illustrated for reference purposes in broken lines in FIG. 9 of the drawings.

The projectile cartridge comprising a hardened steel projectile 16 having a pyrotechnic pure magnesium end contact igniter cap 17 thereon. The projectile 16 has a monolithic cylindrical body member 18 with oppositely disposed flat end surfaces 18A and 18B. The hardened steel projectile 16 is, in this example, high density cemented tungsten carbide steel 91.8-92.8 Rockwell A scale and is illustrated in a twelve-gauge shell dimension for illustration. It will be evident that the dimensional variances are not limited to the preferred embodiment designation but can vary depending on applicant's use venue. The end contact pure magnesium igniter cap 17 has a recessed cylindrical base 17A with a contoured dome end portion 17B. The cap base 17A has an interior diameter for register receiving the corresponding hardened steel cylinder projectile end 18A there within.

Figure 3:
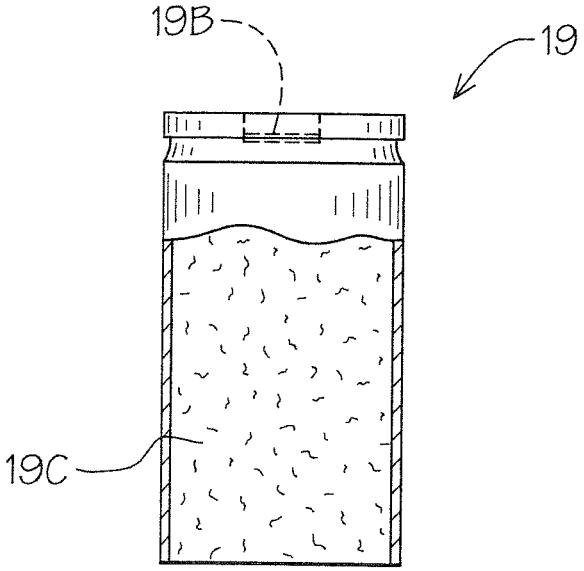
FIG. 3 is a partial cross-sectional view of a secondary propellant cartridge.
Figure 4:
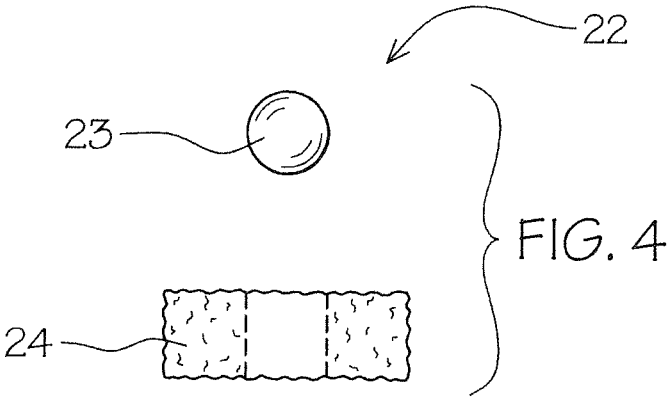
FIG. 4 is an exploded view of a firing pin assembly and support.
Figure 5:
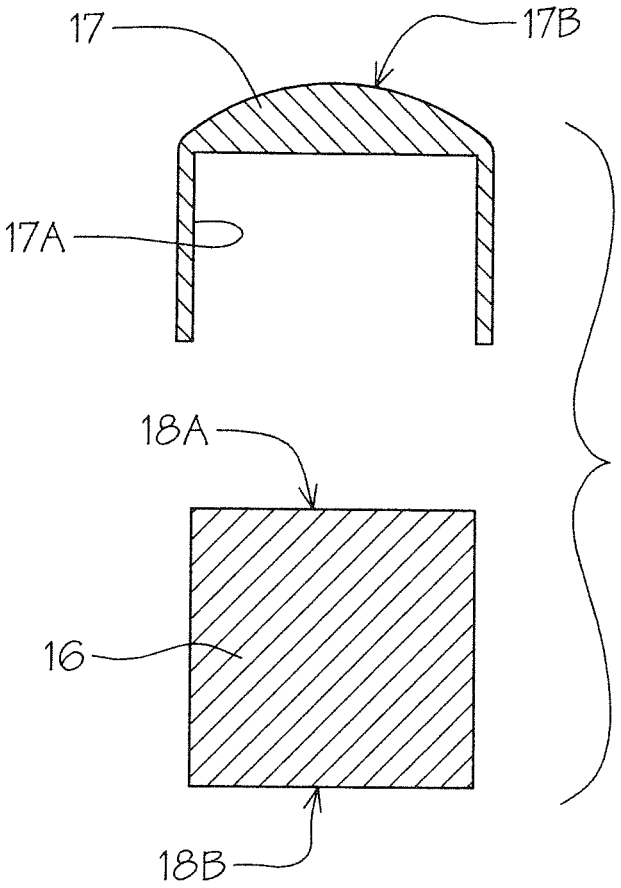
FIG. 5 is an exploded view of the hardened steel projectile and pyrotechnic cap.
Figure 6:
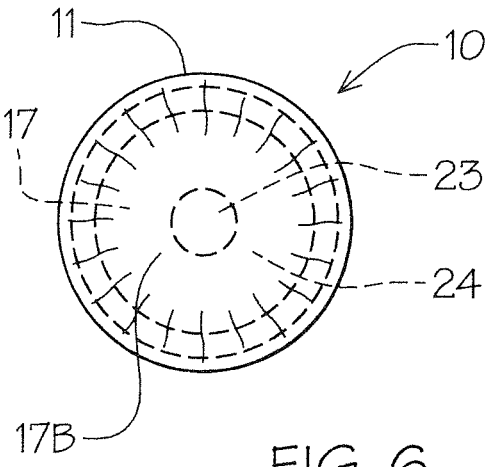
FIG. 6 is a top plan view of the component armor piercing projectile on lines 6-6 of FIG. 1.
Figure 7:
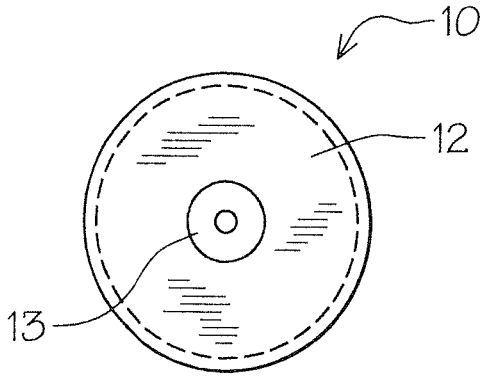
FIG. 7 is a bottom plan view of the component armor piercing projectile on lines 7-7 of FIG. 1.

A second stage firing cartridge 19, best seen in FIGS. 1 and 3 of the drawings, is provided to impart a contact ignition upon striking the target. The cartridge 19 has a metal cylindrical housing 19A with the same configuration as a typical ammunition round with a center firing primer 19B and is filled with a propellant charge 19C as will be well understood by those within the art.

Figure 8:
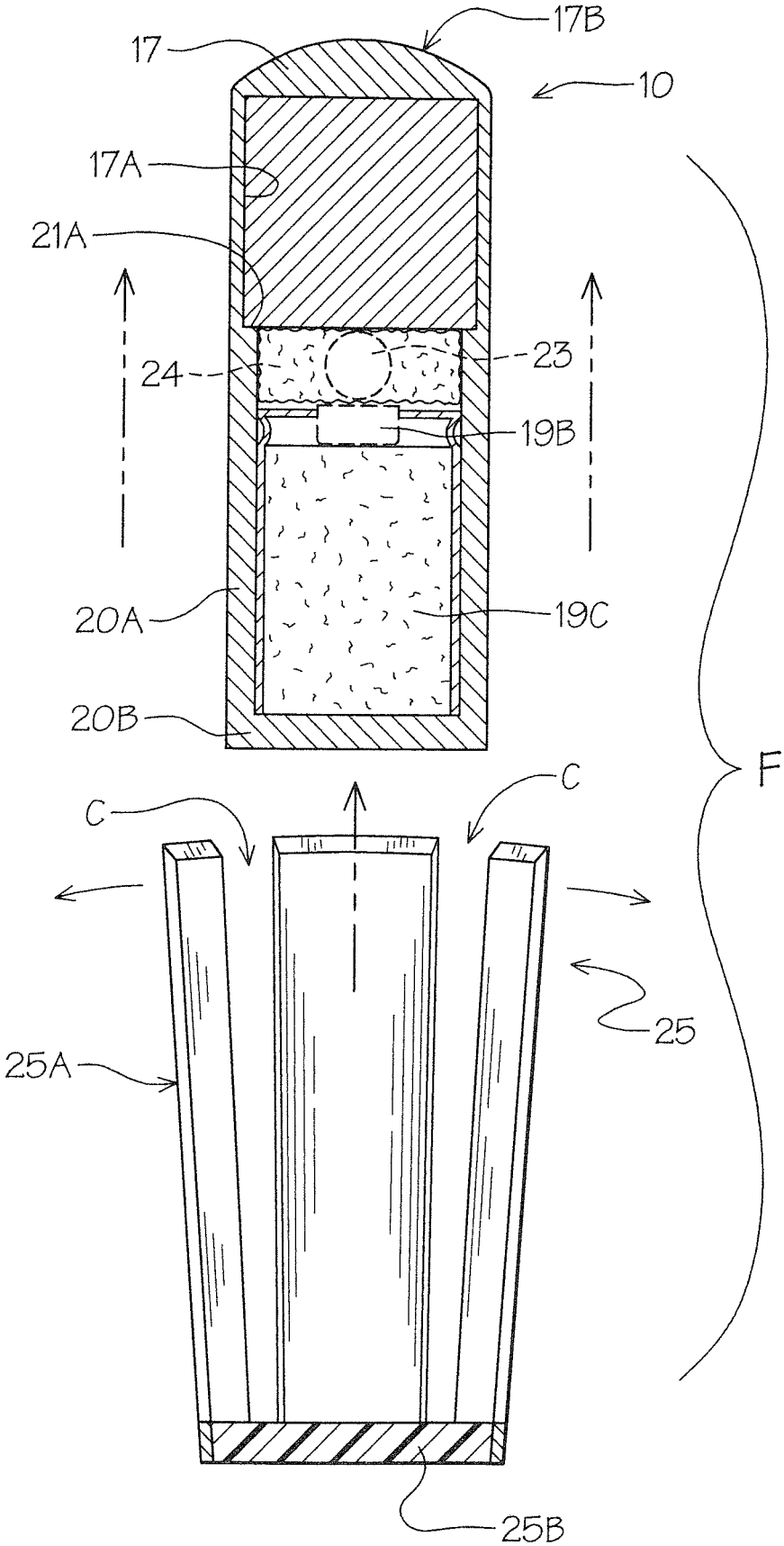
FIG. 8 is an exploded cross-sectional assembly view of the component armor piercing projectile during deployment.

A brass conveyance housing 20 is provided having a cylindrical body member 20A with an integral closed base 20B and oppositely disposed open end 20C. The open housing end 20C has an area of increased interior diameter at 21 extending inwardly therefrom defining an annular support and positioning lip 21A for registerably receiving the projectile base 18B when inserted therein. In operation, the projectile assembly sequence is as follows. The second stage firing cartridge 19 is receivably positioned within the conveyance housing 20 with its firing primer 19B facing outwardly. A cartridge firing pin assembly 22 comprises of a steel firing pin ball 23 which is held centrally within an expanded flexible synthetic resin foam collar 24 which is positioned on top of the firing cartridge 19 in the assembly. The monolithic projectile 16 is then registerably received within the housing 20 on the interior support lip 21A as hereinbefore described. The projectile 16 is in direct contact with the igniter cap 17, in this example, which is magnesium which engages engaged the housing open end at 20C, edge 20D as best seen in FIGS. 1 and 8 of the drawings.

The projectile cartridge assembly, as hereinbefore described, is in turn fitted within a stabilization sabot 25 made from plastic, in this example, defining a shroud thereabout. The sabot 25 has an annular sidewall 25A with multiple spaced cuts C thereabout, an annular base 25B of increased dimension mass. The sabot 25 will thus support and stabilize the projectile cartridge assembly during its initial launch then separate and split open as seen in FIG. 8 of the drawings induced by the sabot velocity during high speed deployment before target contact.

The projectile conveyance housing 20 abuts the bottom of the sabot 25 during cartridge assembly, as noted, having with its bottom exterior surface 26 effacing the cartridge propellant charge 14 which in this application is smokeless gun powder infilling the remaining hull 11 interior area in direct contact with the hereinbefore described cartridge primer 13.

Referring now to FIG. 9 of the drawings, a graphic illustration of the armor piercing projectile cartridge 10 of the invention in explosive impact on a target armor 27 representation can be seen.

Upon projectile assembly impact with the target armor 27, the pyrotechnic magnesium cap 17 ignites indicated generally at 28 on the target armor plate 27. The kinetic impact force on the hardened steel projectile 16 compresses the cartridge firing pin assembly 22 with its firing pin ball 23 into the center firing primer 19B of the second stage cartridge 19 firing same. The simultaneous impact and cartridge 19 firing provides additional penetrating force of 500 ft. lbs. to propel the hardened steel projectile 16 as it exits the housing 20 shown graphically for illustration in FIG. 9 of the drawings. It will be seen that the enhanced velocity of the projectile 16 by the second stage cartridge 19 upon contact combined with the kinetic energy imparted by the propellant charge 14 that initiates the second stage projectile assembly trajectory to the target and the high temperature impact of the ignited magnesium 17 will achieve optimum ballistic performance against the target armor 27 not achievable by conventional penetration rounds known within the art. It will be evident from the above description that during the milliseconds that occur after impact and ignition of the magnesium end cap 17, the surface area of the target armor 27 will be heated rapidly thereby weakening the armor's molecular bonding structure which in combination with the enhanced kinetic energy of the hardened steel projectile 16 by the firing of the second stage cartridge 19 will effectively provide an equal and opposite force presentation to the projectile 16 will then penetrate the target armor 27 and pass there through at 29 as illustrated graphically in FIG. 10 of the drawings.

It will thus be seen that a new and novel composite two-stage armor piercing cartridge of the invention has been illustrated and described and it will be apparent to those skilled in the art that various changes and modifications may be made thereto without departing from the spirit of the invention.

Therefore, I claim:

1. A two-stage armor penetrating projectile cartridge comprising, a cylindrical cartridge hull having an open end and an oppositely disposed brass head closure, a propellant and primer in said cartridge hull, a projectile assembly registerably positioned within said cartridge hull, said projectile assembly comprising, a steel hardened projectile having a pyrotechnic igniter cap thereon, a second stage firing cartridge, a second stage cartridge firing pin assembly within an open-end cylindrical metal conveyance housing, a one-piece sabot engaged around said cylindrical metal conveyance housing.

2. The two-stage armor piercing projectile cartridge of claim 1 wherein said cylindrical metal conveyance housing has an annular sidewall and an integral base.

3. The two-stage armor penetrating projectile cartridge of claim 1 wherein said cartridge firing pin assembly comprises, an expandable flexible foam collar and a steel firing pin sphere centrally positioned within said foam collar.

4. The two-stage armor piercing projectile cartridge of claim 1 wherein said one-piece sabot comprises, an annular sidewall, annular spaced longitudinal cuts in said sidewall, an integral solid base of a dimensional thickness greater than said sidewall dimensional thickness.

5. The two-stage armor piercing projectile cartridge set forth in claim 1 wherein said open end cylindrical metal conveyance housing has an area of increased interior diameter extending inwardly from the metal conveyance housing open end for registerably receiving said steel hardened projectile therewithin.

6. The two-stage armor penetrating projectile cartridge set forth in claim 1 wherein said steel hardened projectile is in selective communication with said cartridge firing pin assembly.

7. The two-stage armor penetrating projectile set forth in claim 1 wherein said second stage firing cartridge comprising, a cylindrical housing having a closed end and an open end, a primer within said closed end and a propellant charge within said cylinder housing in direct communication with said primer.

8. The two-stage armor penetrating projectile cartridge set forth in claim 1 wherein said pyrotechnic igniter cap is of magnesium.

9. The two-stage armor piercing projectile set forth in claim 1 wherein said cylinder cartridge hull has a crimped free annular open end engaging said pyrotechnic igniter cap.

10. The two-stage armor piercing projectile set forth in claim 1 wherein said cylinder metal conveyance housing is of brass.

* * * * *